US006499513B1

(12) United States Patent
Couch

(10) Patent No.: US 6,499,513 B1
(45) Date of Patent: Dec. 31, 2002

(54) METHOD AND APPARATUS FOR MANUFACTURING SEWN GOODS

(75) Inventor: Erick C. Couch, Redondo Beach, CA (US)

(73) Assignee: Andrew M. Bakaysza, Redondo Beach, CA (US)

( * ) Notice: Subject to any disclaimer, the term of this patent is extended or adjusted under 35 U.S.C. 154(b) by 0 days.

(21) Appl. No.: 09/714,765

(22) Filed: Nov. 15, 2000

(51) Int. Cl.[7] ..... D05B 21/00
(52) U.S. Cl. ..... 139/470.03; 139/470.05
(58) Field of Search ..... 112/470.03, 470.05

(56) References Cited

U.S. PATENT DOCUMENTS

| | | | | |
|---|---|---|---|---|
| 3,701,165 A | | 10/1972 | Huddleston | |
| 4,404,919 A | | 9/1983 | Martell et al. | |
| 4,532,655 A | | 8/1985 | Bowditch | |
| 4,612,867 A | | 9/1986 | Rosch et al. | |
| 4,658,741 A | | 4/1987 | Jehle et al. | |
| 4,785,750 A | * | 11/1988 | Best | 112/10 |
| 5,205,232 A | * | 4/1993 | Sadeh et al. | 112/262.2 |
| 5,309,840 A | | 5/1994 | Takamura et al. | |
| 5,686,725 A | | 11/1997 | Maruyama et al. | |
| 5,939,468 A | | 8/1999 | Siddiqui | |
| 6,216,619 B1 | * | 4/2001 | Musco et al. | 112/475.05 |
| 6,263,816 B1 | * | 7/2001 | Codos et al. | 101/35 |

* cited by examiner

*Primary Examiner*—Andy Falik
(74) *Attorney, Agent, or Firm*—James E. Brunton, Esq.

(57) ABSTRACT

A method and apparatus for sewn article fabrication wherein the article components are strategically imprinted with processing information using an ink that when irradiated is readable by an operator as well as by strategically located sensors. The printed components are then moved through a sewn goods manufacturing process wherein the indicia is detected and used as reference points to accomplish various manufacturing steps, such as cutting, folding, stitching, and relative positioning of garment components. The ink that is used to imprint the processing information is either invisible or substantially invisible to the naked eye, but becomes readable under exciting radiation such as ultraviolet light.

29 Claims, 6 Drawing Sheets

METHOD AND APPARATUS FOR MANUFACTURING SEWN GOODS

BACKGROUND OF THE INVENTION

1. Field of the Invention

The present invention relates generally to sewn goods and to the method of making same. More particularly, the invention concerns a computer aided method that involves the use of fluorescent ink visible primarily under exciting radiation for communicating various instructions to computers and humans to aid in identifying cutting, transporting, assembling, ironing, packaging and shipping of various types of sewn articles.

2. Discussion of Prior Art

In the fabrication of sewn articles, such as clothing, footwear, and luggage various steps must be performed including the step of cutting the components that make up the sewn article to the correct size and shape and then sewing the components together to form the sewn article. These steps must be accomplished with great precision so that the various components that make up the garment are properly mated together to form the finished article.

Until relatively recently, the various steps involved in the fabrication of sewn goods, such as clothing, have been performed by hand. However, in the past several years a number of different types of machines, including high-speed sewing machines, have been developed to assist the worker in the fabrication of garments and to speed up the garment fabricating process. In addition to the development of high-speed sewing machines, high-speed fabric cutting devices and folders have also come into common use. However, even with the many advances that have been made, many of the steps in the garment fabrication operation are still being carried out by hand and the industry must still rely heavily upon the skill of the machine operator for identifying cutting, transporting, assembling, ironing, packaging and shipping of various types of sewn articles. The present state of the art is such that minor flaws are present on most finished sewn goods.

Since contemporary sewing machines can sew at speeds up to at least 9000 stitches per minute, proper hand orientation of components of the garment is very difficult and requires highly skilled operators. Because of the high-speed of modern sewing machines, even the most skilled operators have to stop frequently to check the accuracy of their work. Additionally, it is difficult for the operator to continuously feed the sheet materials to be joined through the machine while at the same time maintaining the correct alignment of the side edges thereof. This becomes even more difficult when the cloth components are made from a soft cloth material. In practice, therefore, the operator must, from time to time, stop the machine to manually adjust the alignment of the side edges of the sheet materials as they are fed toward the needle. This inevitably causes undesirable interruptions and delay in the sewing operation. Even though machines can operate at greater than 9000 stitches per minute, they are not able to utilize this great speed for any length of time due to such manual control of the machines. For foregoing reasons, even the use of the latest types of automatic sewing machines can be quite labor-intensive.

At the present time there is a great need in the garment fabricating industry to speed up production and to make smaller runs, while at the same time improving overall quality and repeatability. "Mass Customization"— the manufacture of a single, custom made garment for just one person, for instance, is the direction in which the industry is moving. Thus greater flexibility in manufacturing machinery, and integrated solutions for assembly and finishing of garments is highly desirable. Changing stitches, correcting the feed, sewing along a curved path, sewing within tolerance zones, the ability to apply statistical process control, piece matching, automation, as for example, robotic positioning, pattern matching and error sensing are all extremely desirable. These features are particularly important as the market moves toward smaller lot sizes, and individual garment customization.

In this regard, due to the small lot size of individual runs, operators typically learn how to manufacture a particular size and type of garment. The lengths, pattern matching, fold tolerances and the like for the particular garment are largely maintained through operator interfacing. This mode of operation continues to rely heavily on well-trained operators and expensive operator training, monitoring, and quality control. However, even with careful training substantial amounts of material and labor is wasted due to mistakes in the learning process. Also, throughout the industry, there continues to be undesirably wide variations in the consistency of the final products that are produced.

In accordance with conventional prior art garment fabrication procedures, the CAD/CAM software links the design activity to the cutting machines. Cutting machines are driven by CAD/CAM files. This link, however, is virtually nonexistent between the design activity and the sewing machines. Once material is cut, operators must load and sew the material manually. For instance, an operator must insert the cloth into a sewing machine, then manually lower the feet onto the cloth to hold it in place, then press on a foot pedal to commence sewing and to control sewing speed. Assembly tolerance bands, as for example that of a stitch path, are maintained by the operator's eye, hand, and foot coordination. Contemporary sewing speeds are such that small imperfections are hard to catch and it is easy to make a mistake. Accordingly, these processes place substantial demands on the operator requiring remarkable intensity and an alertness on the part of the operator if costly errors are to be avoided.

Because of the drawbacks of the prior art garment fabrication techniques as discussed in the preceding paragraphs, considerable effort has been directed toward creating a more automated manufacturing environment wherein operators do not have to be specially trained for each size, shape, and garment redesign. More specifically, an attempt has been made to develop a cloth marking technology that uses indicia that can be sensed by-machine control sensors. By way of example, U.S. Pat. No. 3,701,165 issued to Huddleson discloses such a technology. However, the Huddleson approach requires that the thread or ink contain iron oxide that is visible to the naked eye. Therefore, as a practical matter, this technology is useful only for marking areas on the garment that would ultimately be cut away or hidden in seams. This ferromagnetic technology also has the disadvantage that the iron oxide particles must be magnetically charged in order to be sensed by the control sensors thus requiring that some type of charging equipment be located at or near the sewing machine.

In using the Huddleson technology, garment parts which carry a magnetized mark or magnetized stitching are moved through an automated garment manufacturing process with the mark or stitching being detected by appropriate sensors. The sensed marks are then used as a reference point on the garment part to actuate various garment making steps, such as cutting, folding, stitching, and component interconnection.

In addition to the several types of cloth marking techniques that have been suggested, there exists a wealth of customized sewing machines that have been designed to perform a specific function. For example, in the production of a typical dress shirt, twenty or more different specialized machines may be used. In like manner, a number of customized sewing machines have been designed to produce a particular contour through the use of specially designed templates and special fixturing. For example, in making different pocket shapes, industry currently uses a pocket-making machine with hard fixturing for each unique shape. By way of further example, in accordance with long standing prior art garment fabrication methods, the size and shape of various garment components as well as pocket location, button hole location and the like on various types of garments was established using thin tissue paper templates. Such techniques are crude, imprecise are and labor intensive.

As will be better understood from the discussion that follows the methods and apparatus of the present invention will permit machines to be designed without focus on manual operation. Rather, in accordance with the novel methods of the present invention, a single machine can be used to perform many of the operations that currently require a number of separate machines. Additionally, the novel methods and apparatus of the present invention substantially eliminate the cumbersome and time consuming use of templates as well as the need for frequent manual measurement.

Another prior art practice that can be vastly improved using the methods and apparatus of the present invention involves component cutting, folding and transport. In accordance with prior art methods, paper pattern markers are typically laid on top of uncut layers of cloth so that when the cloth is cut, the stacks of pieces will be clearly identified. Then the stacks are manually moved to the assembly area. In accordance with one method of the present invention the use of pattern markers can be eliminated by printing the piece identifier directly on each piece using a radiation-excited invisible ink. Robotic cloth movement systems can then be employed to move and manipulate the components. In this regard, one major difficulty of prior art robotic movement systems was that they were unable to sense when the cloth was folded over upon itself. In accordance with the methods of the present invention, using radiation-excited invisible ink, a unique dot matrix pattern can be imprinted on each side of the cloth so that the sensing systems of the invention can readily determine which side of the cloth is face up. By sensing the distance between the individual dots of the pattern, the sensing system can also determine if the cloth is laying flat. Orientation markings can be provided to enable the robotic cloth movement system to acquire the orientation of the piece. Additionally, symbols can be printed on the pieces that would indicate where the piece is to be picked up by a robotic system, thus enabling automation of cloth movement. By way of further non-limiting example, in making button holes, the button hole locations can be identified by simply printing their locations on the cloth with appropriate invisible ink button hole symbols. Then by providing guidance markings, the machine can simply follow the orientation markings to the first button hole symbol, sew the first button hole, then follow the guidance markings to the next button hole and so on.

Many prior art attempts have been made to facilitate the making of garments with components that have patterns that match exactly. For example it is often desirable to manufacture a garment where the sleeve stripes are directly matched with the shoulder stripes or, additionally, a paisley shirt where the pocket paisleys match correctly with those on the front panel. One prior art method attempts to facilitate the cutting of the components in such a manner that the patterns on the cloth will match when the components are finally joined by projecting the outlines of the components of the garment onto the flat uncut cloth so that adjustments can be made prior to cutting. This involves much operator interfacing and can be time consuming and cumbersome. Employing the methods and apparatus of the present invention invisible fluorescent ink cutting instructions can be printed directly on the cloth prior to cutting, as for example, during the cloth printing step. The cloth cutting machines then sense these instructions and perform the cutting operation in such a manner that the components have patterns that match with great precision.

Another prior art method that aims to solve the pattern matching at the sewing machine is for example, U.S. Pat. No. 4,612,867. This patent describes sensing the variation in intensity of light reflected off two components that are to be matched, sensing alternating short and long patterns in order to then perform matching. The present invention offers an improved solution by requiring only that the invisible ink markings be sensed at the sewing machine in order to perform the aligning operation among components. For instance, a striped material can be printed with unique invisible fluorescent markings along the edge of each stripe. This later can be sensed to match adjoining parts in such a fashion that the stripes match precisely.

U.S. Pat. No. 4,404,919 and 4,658,741 provide methods for controlling the stitch length by counting the number of stitches. These methods have limited application since cloth is flexible and the length of a component, and hence the distance that must be sewn, varies according to how much the cloth has stretched. The use of invisible ink, on the other hand entirely solves this problem since the ink is joined to the cloth. If the ink instructions indicate that sewing is to continue from one point on the component to another, then stretching will not cause the sewing machine to sew short of the desired distance.

Many patents, such as U.S. Pat. No. 5,205,232, describe how to detect the edge of a cloth. With this present application, detecting the edge is no longer important since all operations are actuated based upon symbols sensed to the inside of the component perimeter thus eliminating the need for edge detection.

SUMMARY OF THE INVENTION

In summary, the present invention comprises a method and apparatus for computer aided sewn article fabrication wherein the article components are strategically imprinted with sensor as well as operator detectable indicia. The printed components are then moved through an automated sewn good manufacturing process wherein and the indicia is detected and used as reference points to actuate various manufacturing steps, such as cutting, folding, stitching, and relative positioning of garment components. In one form of the invention the detectable indicia comprises an ink that is either invisible or substantially invisible to the naked eye, but becomes visible under exciting radiation such as ultraviolet light. In this regard, it should be appreciated that the ink may be water soluble so that any residue will be gone after the first washing.

With the foregoing in mind, it is an object of the present invention to provide a novel method for computer aided sewn good fabrication in which human and sensor detectable, instructional indicia are imprinted at strategic locations on the material used to make the sewn good components.

Another object of the invention is to provide a method of the aforesaid character in which the detectable indicia imprinted on the material automatically and precisely controls the accomplishment of the various sewn good fabricating steps.

Another object of the invention is to provide a method of making garments as described in the preceding paragraphs in which the detectable ink used on the garment components is substantially invisible to the naked eye.

Another object of the invention is to provide an apparatus for accurately printing detectable indicia on the components that make up the sewn article.

Another object of the invention is to provide an apparatus for accurately detecting the indicia imprinted on the article components and for then performing various manufacturing processes in response to the detection of such marks or indicia.

Another object of the invention is to provide a method of making sewn goods in which full sewn good reproduction can be routinely achieved without noticeable variation in the completed sewn article that is produced by different operators.

Another object of the invention is to provide a method of making sewn goods as described in the preceding paragraph in which the quality of the sewn good produced does not depend on operator skill and experience.

The other objects, features, and advantages of the present invention will become apparent from the discussion, which follows.

DISCUSSION OF THE INVENTION

Figure 1:
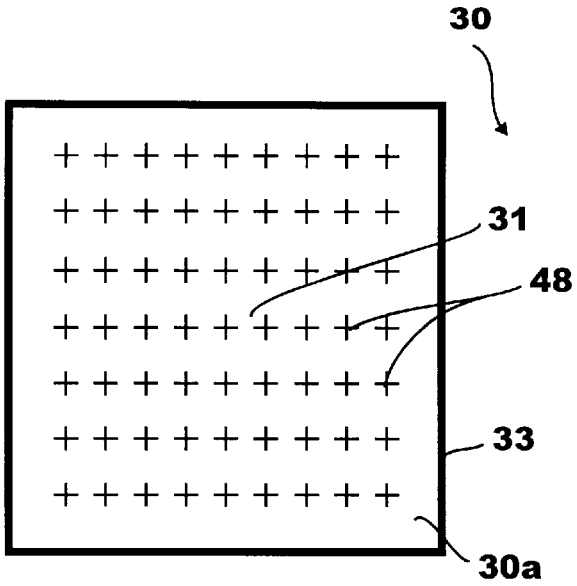
FIG. 1 is a top plan view of piece of fabric upon which a first type of indicia has been imprinted.

Referring to the drawings, one form of the method and processing apparatus of the invention for manufacturing sewn goods from a starting material such as a work piece having an upper and lower surface is there illustrated. The processing apparatus of the invention here comprises a computer controlled sewing machine, the character of which will presently be described. Uniquely, the method of the invention comprises the novel step of using a radiation excitable, fluorescent ink to imprint instructional information on the upper and lower surfaces of the starting material. Preferably the unirradiated ink is invisible to the naked eye. However, when the ink is excited by radiation, it becomes visible to the operator and can also be detected by appropriate sensor means. In a manner presently to be described, the sensor means of the invention functions to read the irradiated instructional information imprinted on the fabric and to transmit the information to the central processing unit of the computer of the sewing apparatus.

As will be discussed in greater detail hereinafter, the instructional or processing information imprinted on the work piece or fabric provides detailed operational instructions, as for example cutting instructions, stop and start instructions, fabric folding instructions, fabric positioning instructions, stitching instructions and various special instructions concerning the verification of edge location, seam length, specified tolerance zones and size, location and style of zippers, button holes, buttons, pockets and the like.

Figure 9:
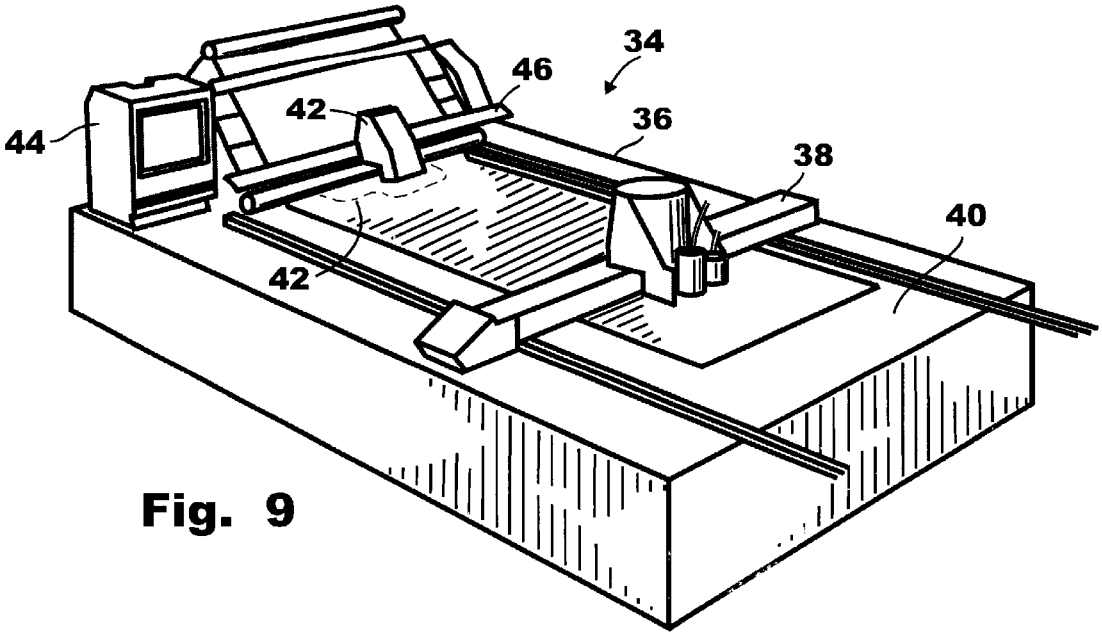
FIG. 9 is a generally perspective view of a spreading apparatus embodying a top side and bottom side printer and a black-light scanner affixed to a cutting head and carriage.
Figure 10:
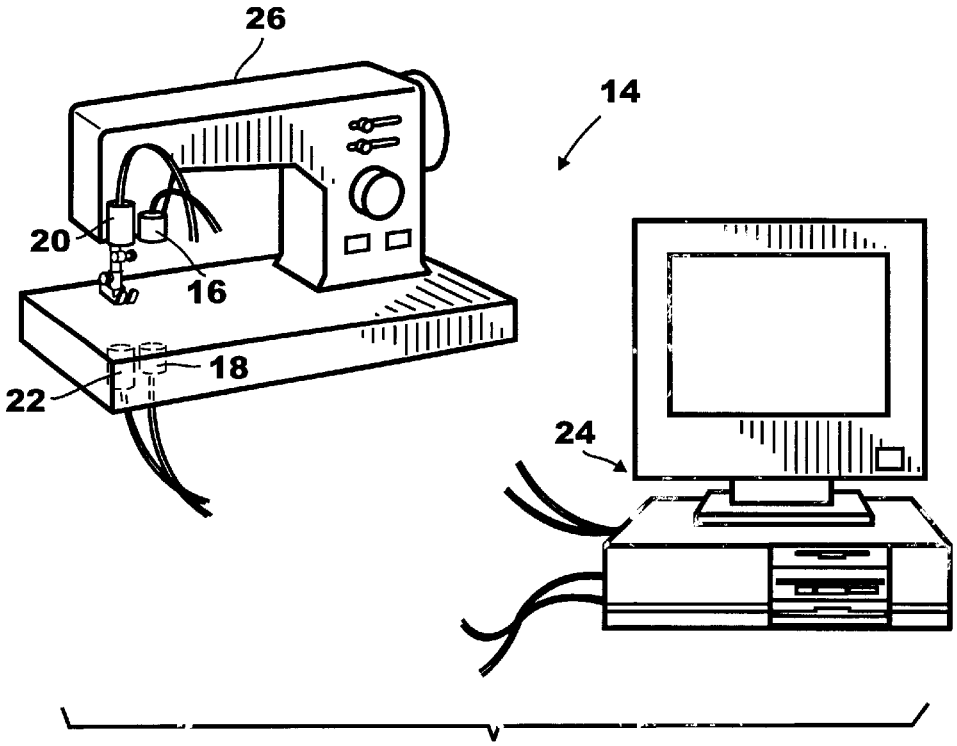
FIG. 10 is a generally perspective, diagrammatic view of a modified sewing machine having optical sensors and black lights affixed thereto and illustrating the interconnection of the sewing machine with the control means of the invention.

Referring to FIGS. 9 and 10, one form of the processing apparatus of the invention is there illustrated. As shown in FIG. 10, the apparatus comprises a computer controlled sewing machine generally designated by the numeral 14. The sewing machine here includes radiation emitting means for emitting infrared rays of, for example, about 0.2 to about 10 micrometer wave length. These emitting means here comprise upper and lower emitters, or black lights 16 and 18 respectively, for exciting the ink imprinted on the fabric components that will be used to manufacture the sewn garment. Black lights 16 and 18 are of conventional construction and are readily commercially available from various sources. Also forming a part of the sewing machine of the invention are sensor means comprising upper and lower optical sensors 20 and 22 respectively. Sensors 20 and 22 measure the amount of infrared rays emitted from the ink markings and in this way function to read and then transmit to the central processing unit (CPU) of the computer 24 of the apparatus the instructional information imprinted on the fabric. While not shown in FIG. 10, the sewing machine apparatus could have another set of black lights and optical sensors on the other side of the needle to facilitate processing in the back to front direction.

The automatic sewing machine component 26 of the apparatus shown in FIG. 10 is of a conventional design that is capable of carrying out sewing instructions received from the appropriately programmed CPU. The CPU reads the markings on the fabric, which actuate certain responses. The code that is executed can either be of a general nature, such as "sew straight" or "sew button hole" or a garment specific nature, such as "sew special design for pocket embroidery for garment number 1673545357", As previously mentioned, a number of prior art automatic sewing machines are now commercially available that can readily be programmed by those skilled in the art to carry out the various functions specified by the instructional material imprinted on the fabric used in carrying out the method of the present invention.

Note that in the preferred embodiment, a new "layer" is developed in CAD systems to drive the invisible ink printing process. This layer would automatically extract the location and type of most of the instructional and orientational markings and would also have a tool pallet from which to tailor the assembly process and instructions. This would enable start to finish manufacturing to be designed at the CAD operation for later execution. In one version, the CAD/CAM system is now linked with the sewing machines such that when the sewing machine scanner reads a certain marking, a series of steps are actuated based upon the information in the CAD/CAM system. This has the tremendous benefit of enabling rapid optimization of the assembly process since modifications can be repeatably and more automatically tested. Also, modifications can be made to the master CAD/CAM file such that all the garments in process will be assembled in a modified improved fashion.

Figure 2:
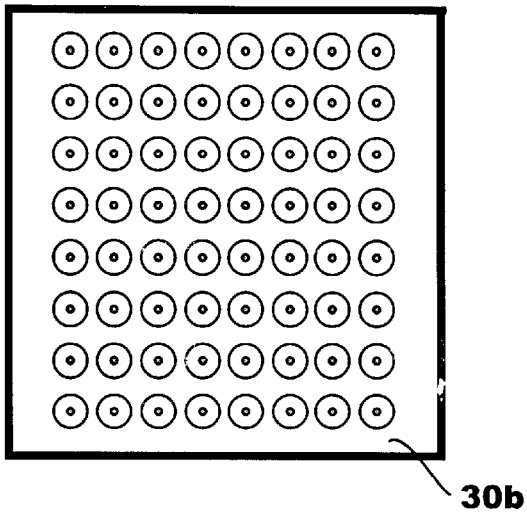
FIG. 2 is a bottom plan view of the piece of fabric shown in FIG. 1 showing a second type of indicia imprinted on the rear surface.
Figure 8:
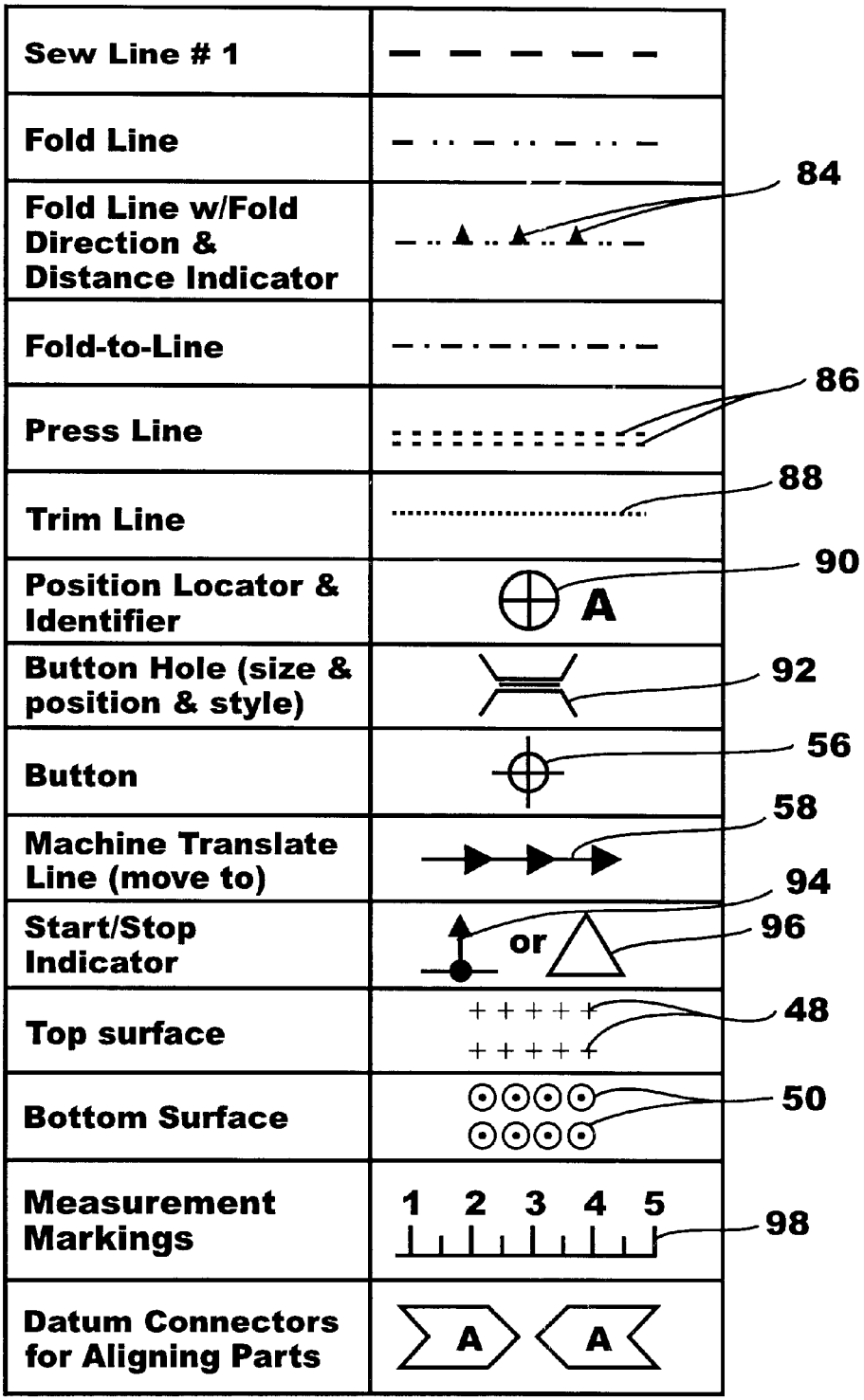
FIG. 8 is a generally diagrammatic view identifying, by way of example, various indicia that can be imprinted on fabric components in accordance with the method of the invention.

The first step in one form of the method of the invention comprises the step of producing a printed fabric by imprinting on the upper and lower surfaces 30*a* and 30*b* of the fabric 30 instructional information such as that shown in FIGS. 1, 2 and 8 of the drawings. As shown in the drawings, the printed material has a central portion circumscribed by a margin. The instructional material is printed on the fabric interiorly of the margin using a radiation excited ink, such as an ink that is excited by black lights 16 and 18 in a manner to emit infrared rays. Several inks of this type are discussed in U.S. Pat. No. 5,939,468 issued to Siddiqui.

In the one form of the invention, this printing step is accomplish using an apparatus of the character illustrated in FIG. 9 which comprises a modified, conventional type cloth spreader and cutter apparatus. This apparatus, which comprises a part of the processing apparatus is generally designated by the numeral 34. The apparatus here comprises a cloth spreader and cutter apparatus 36, having a cutter head and carriage 38 that is movable longitudinally of the cloth supporting bed 40. Apparatus 36 is of conventional design and is readily commercially available from various sources such as the Lectra Systems Company that has a place of business in France. For purposes of the present invention, the commercially available apparatus is modified to include printer heads 42 that are mounted above and below the cloth supporting bed 40 (FIG. 9). Printer heads 42 are also of conventional construction and preferably include ink jet heads that function to precisely deposit the excitable ink onto the fabric in accordance with instructions received from a computer 44 to which the printer heads are operably associated. In operation, as the fabric is moved forwardly of the cutter bed, the printer heads 42 move transversely of the printer carriage 46 and in so doing controllably imprint onto the upper and lower surfaces of fabric, 30 the desired indicia. Additionally, many layers of cloth 30 can be piled upon the supporting bed 40 with alignment of both the decorative patterns as well as the invisible ink instructional symbols maintained through all the layers by scanning each layer as it is laid upon the supporting bed and actuating a correction in the spreading operation if necessary. Where desired, more than one printer head could be mounted on the top and bottom carriage to speed the process.

Alternately, the printing of the invisible ink markings could be accomplished at prior to introduction to the spreading and cutting apparatus 34. Printed cutting lines could then be used to drive the cutting process in addition to the entire downstream assembly process. For example, invisible ink markings could be printed while the cloth is being printed with a decorative design, such as a paisley pattern.

Figure 3:
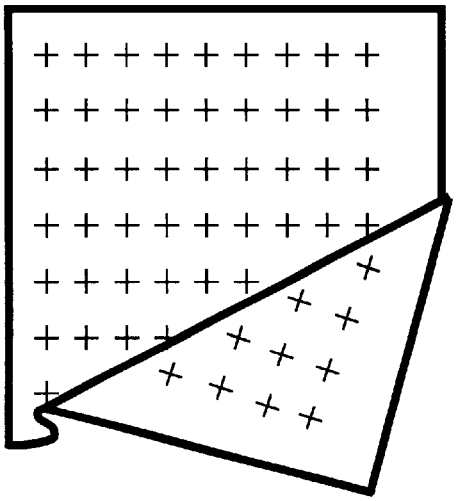
FIG. 3 is a diagrammatic plan view similar to FIG. 1 but showing the piece, of fabric in a creased condition.
Figure 4:
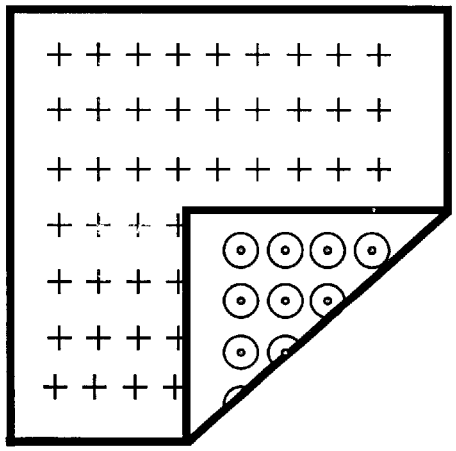
FIG. 4 is a diagrammatic plan view similar to FIG. 1 but showing the piece of fabric in a folded configuration.
Figure 5:
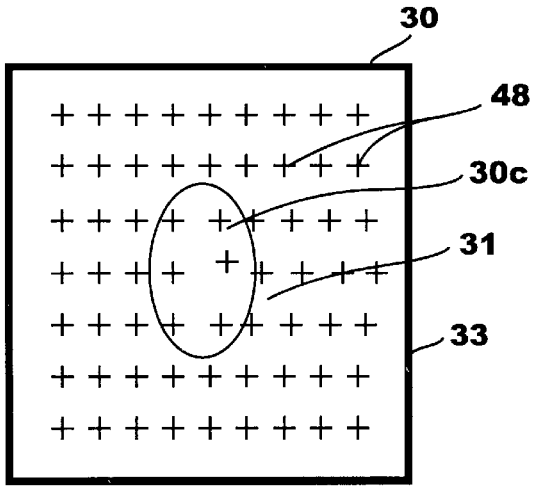
FIG. 5 is a top plan view of a piece of fabric similar to that shown in FIG. 1, but having been stretched so as to separate certain of the indicia imprinted thereon.

By way of example, in accomplishing the printing step of one form of the method of the invention, a multiplicity of cross-shaped indicia 48 are imprinted in a grid pattern on upper surface 30, while a multiplicity of circular shaped indicia 50 are imprinted in a grid pattern on lower surface 30*b* (see FIGS. 1, 2 and 8). As the material is fed under the scanners 20 and 22 of the automatic sewing machine, the scanners will be able to verify that the fabric is facing in the correct direction. Further as illustrated in FIGS. 3 and 4, the scanners will also be able to confirm that the fabric is not bunched or folded. If the fabric is unduly stretched as indicated in FIG. 5, the scanner will also be able to detect the abnormal spacing of the grid indicia within the defective area 30*c* of the fabric and appropriately interrupt the sewing operation.

Figure 6:
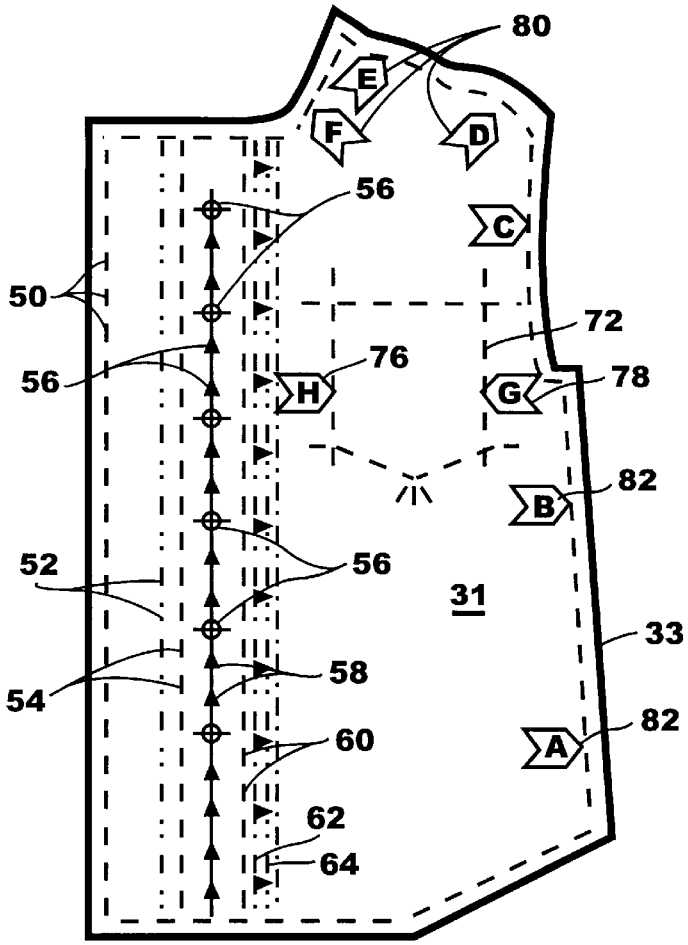
FIG. 6 is a top plan view of a component used in the fabrication of a shirt showing various types of indicia imprinted thereon.
Figure 7:
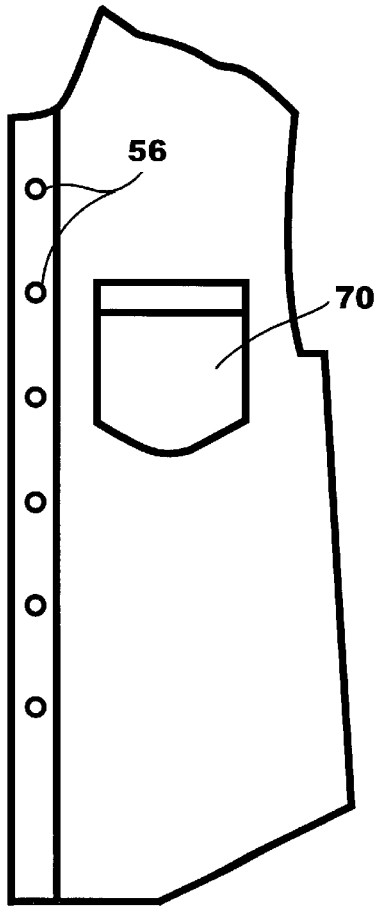
FIG. 7 is a top plan view of the finished shirt component.

Turning next to FIGS. 6, 6A, 7, and 8, the method of making a shirt component is there illustrated. As illustrated in FIG. 6, in this example, a variety of ink markings have been imprinted on the fabric by the printer heads 42. For example, indicia 52, which here comprises a series of double dots and dashes indicates the location of a first fold line, while indicia 54 indicates a first sew line. A second sew line 60 is indicated by the dash lines that parallel the translate lines while second and third fold lines 62 and 64 are disposed between second sew line 60 and a fold-to line indicia 66 that comprises single dots and dashes (see also FIG. 8 for further identification of the indicia shown in FIG. 6). Disposed adjacent first sew line 54 are spaced apart indicia 56 that are in the form of a cross superimposed over a circle. Here indicia 56 functions as a position locator and indicates the desired position of the buttons on the shirt. Disposed intermediate position locator indicia 56 are machine translate lines 58 indicating a translation of the sewing head in the direction of the arrows. FIG. 7 illustrates the finished shirt component folded and sewn in accordance with the various imprinted indicia.

Figure 6A:
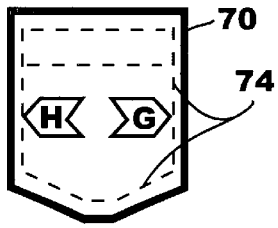
FIG. 6A is a top plan view of a pocket component that can be affixed to the component shown in FIG. 6 and illustrating indicia imprinted upon the pocket component.

FIG. 6A shows a pocket 70 of a particular configuration that is to be affixed to the shirt component shown in FIG. 6. Sew lines 72 imprinted on the shirt component shown in FIG. 6 and sew lines 74 imprinted on the pocket component 70 indicate the location and mating sew lines for sewing the pocket 70 to the shirt component. In this regard, it is to be noted that indicia in the form of datum connectors 76 and 78 are imprinted on both the pocket 70 and the shirt component illustrated in FIG. 6. The datum connectors, or indicia 76 and 78 are aligned to precisely locate the pocket on the finished shirt component shown in FIG. 7.

Other datum connector indicia, such as indicia 80 is imprinted proximate the upper margin of the shirt component, while datum connector indicia, such as indicia 82, is imprinted proximate the central and lower margins of the shirt component. Indicia 80 and 82 can be mated with like indicia imprinted on the mating shirt components to precisely locate various mating components with the component shown in FIG. 6.

Referring particularly to FIG. 8, it is to be noted that several other instructional indicia can be imprinted on starting materials such as garment components. For example, the indicia designated by the numeral 84 can be imprinted on the garment component to indicate a fold line and also to indicate the direction in which the fold is to be made. Indicia 86, which comprises parallel dash lines, can be used to indicate press lines, while indicia in the form of a series of dots 88 can be used to indicate a trim line. Similarly, indicia in the form of a cross within a circle, such as indicia 90, can be used as a position locator and identifier. In like manner, the indicia identified in FIG. 8 by the numeral 92 can be used to indicate button hole size, position and style. Start/Stop indicator indicia such as those designated by the numerals 94 and 96 can be used to instruct the sewing machine to stop or start at prescribed locations.

Finally, measurement markings such as those identified by the numeral 98 in FIG. 8 can be used to provide instructional information as to various measurements that need to be communicated to the operator and to controls of the sewing machine.

It is to be understood that the various instructional indicia discussed in the preceding paragraphs are identified by way of example and not by way of limitation. Clearly, a number of other types of instructional indicia could be imprinted on the sewn articles to indicate a large number of different operations that could be performed by the sewing machine in accordance with instructions given to the sewing machine by its associated computer and computer software. It is also to be understood that in the preferred form of the method of the invention, the instructional information is sensed by the sensors of the apparatus by measuring amounts of infrared rays emitted from the irradiated ink. Accordingly, the sensors can take the form of the optical sensors previously discussed, or, by way of further example, can take the form of a camera or other instrument sensitive. to infrared radiation. As earlier discussed, preferably the instructional information becomes visible to the naked eye upon being irradiated so that the operator can also be visually advised of the instructional material and can thereby monitor and, if necessary, interrupt the automated sewing operations.

Alternately, one application of the invention described herein is simply to print the instructions on the starting material or garment components and then provide a black light to the operator to irradiate the instructional material so that the instructional material can be read enabling the various operations to be executed by hand. While not nearly as fast as the scanner sewing machine integrated method, this still would do much to reduce variation, to increase the flexibility with less training for individual garments.

In accomplishing one form of the method of the invention the imprinted fabric component is initially introduced into the processing or sewing machine apparatus so that the scanner can initially read a start symbol as, for example, a stitch name, a stitch length, a stitch width, a thread color, or the like as indicated by the instructional indicia imprinted on the fabric. Additionally, in one form of the invention the sensor will read both surfaces of the fabric to verify that the fabric is facing in a correct direction and also that it is neither folded nor undesirably bunched in the manner indicated in FIGS. 3 and 4. Following initial verification, the scanners continue to scan the identification and orientation markings. This step will automatically pull up a host of sewing parameters contained in the database related to the particular garment component being feed into the sewing machine.

Upon reaching the start symbol and sensing the start direction, sewing can be commenced in accordance with the instructional information imprinted on the fabric component. During the sewing operation, the correct folding and edge positioning is monitored continuously. Typically, stitching is commenced at the start indicia and then controllably proceeds along the direction indicated by the stitching indicia. Preferably the optical scanners are synchronized with the sewing machine feeders to capture images during the non-movement phase of the operation to, if necessary, eliminate blur. Stitching continues along the stitch line with appropriate deviations being corrected by the feeder feet within a tolerance zone specified by the particular software.

Based on the pre-programmed operational sequence, the material is moved from the initial step to the next step, which may involve, by way of example, movement in a different direction or the commencement of a different stitch, the commencement of a specialized sewing operation such as the sewing of a button hole or the like. Upon completion of the sewing operation in accordance with the imprinted instructional information and the controlling software, either the operator or the automated transport system is summoned to move the completed piece and prepare for introduction of the next piece into the sewing machine. In the preferred form of the invention, the instructions for the next step are printed directly on the fabric component so that, when an initial sewing step is completed movement markings or guide markings for specific instructions actuate the feeder feet to automatically move to the next operational sewing point. For example, the feeder might be instructed to back up along the same path that it has just sewn in order to perform another stitching operation. Alternatively, feeder movement markings might cause the feet to move the component along a prescribed path to arrive at the next starting position.

Figure 11:
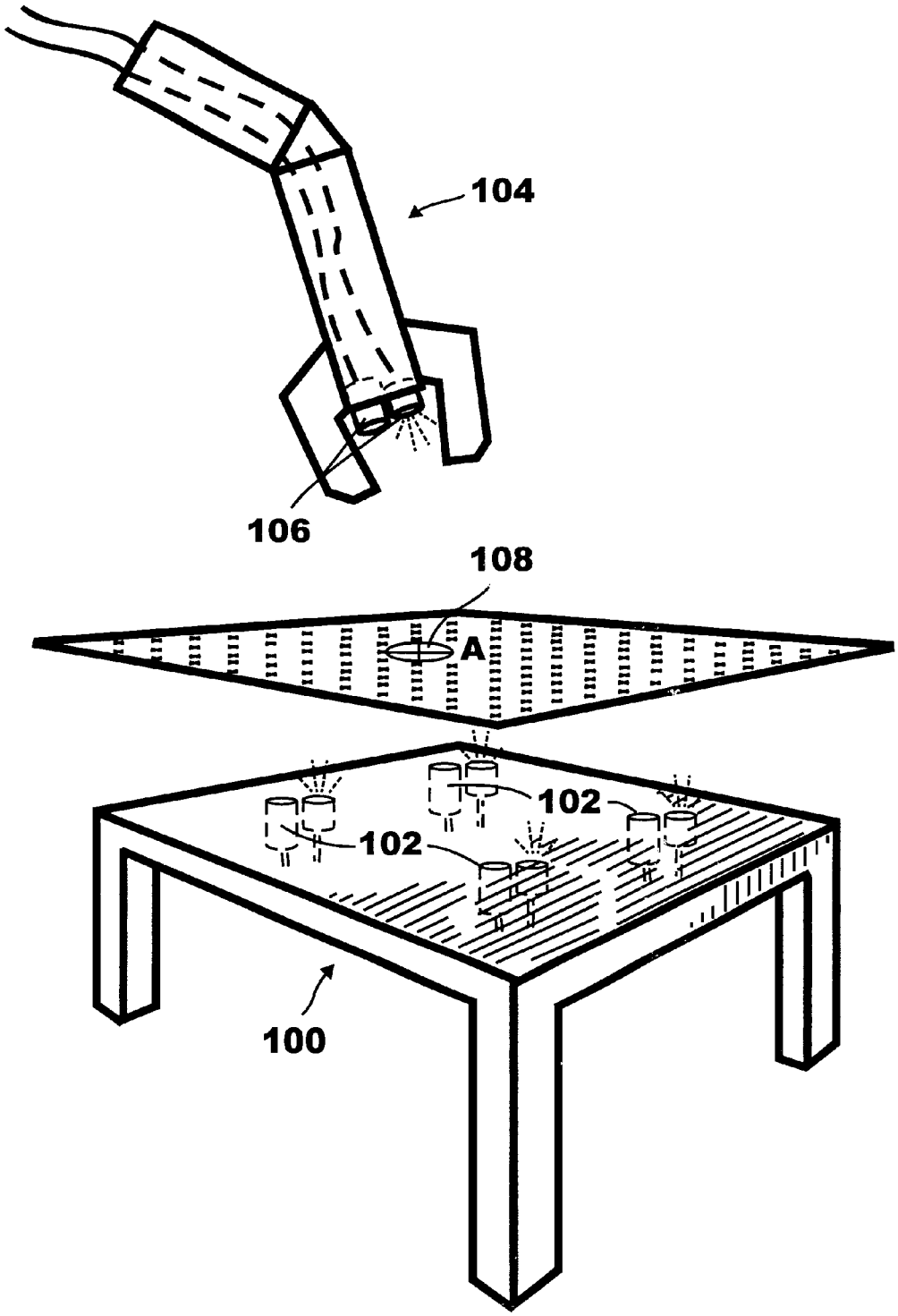
FIG. 11 is a generally perspective view of a modified table having optical sensors and black lights embedded therein as well as a robotic transport arm having optical sensors and black lights affixed thereto as well as a is a piece of fabric showing various types of indicia imprinted thereon.

FIG. 11 contains a transport table 100, a piece of cloth 110 being sensed and moved, and a robotic material handling arm, 104. This figure depicts a robotic arm equipped with a black light and sensor module 106 that will enable the system to locate the part, identify the top & bottom surface via the matrix patterns, identify any folding of the cloth, bunching, stretching, identify position locators, and other processing symbols and information so that it may transport the material to the appropriate processing station and prepare the material for processing by sensing any non flat material and responding by performing a flattening operation. It can also feed the cloth directly into the sewing machine and perform a number of operations in conjunction with the sewing machine to process the sewn article. These may include, but are not limited to, the identifying, cutting, transporting, assembling, ironing, packaging and shipping of various types of sewn articles. In FIG. 11 robotic arm 104 is shown sensing the position locator symbol 108. This position locator indicates where the arm is to grasp the material for movement.

FIG. 11 also shows the cloth 100 above the transport table 100 with sensors and black lights embedded in the table surface 102. Here the table continuously scans the cloth as the cloth is moved across it. In the preferred system, this table is equipped with a transporting means such as sewing machine like feeder feet, or a conveyor system or the like. In this manner, the scanners can acquire various markings printed with the aforementioned irradiating ink, then the associated computer system can actuate various movements of the transport system, the robotic arm, or, if the table is directly adjacent the sewing machine, the system can actuate various steps of the sewing process.

Figure 12:
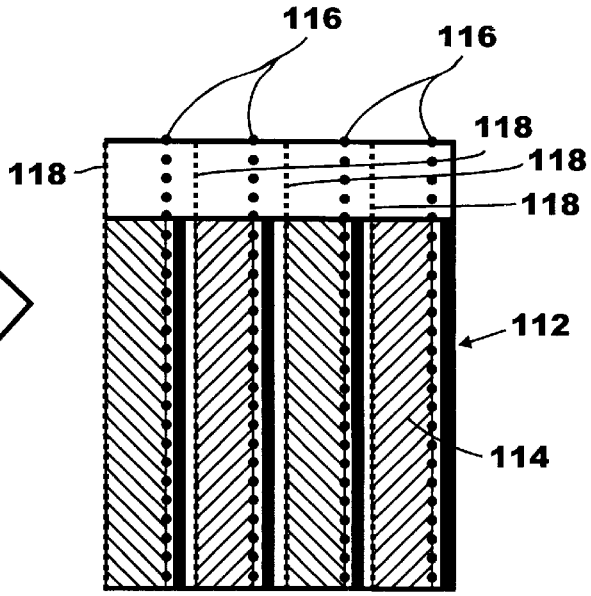
FIG. 12 is a top plan view of a patterned piece of fabric with invisible ink markings printed along the key feature interfaces.

FIG. 12 shows a section of cloth 112 with a particular pattern printed thereon 114. In this preferred embodiment, as the cloth is printed with the pattern, invisible fluorescent markings are also printed along key features of the pattern. Here, the lines, 116 and 118 are each unique and indicate different features of the pattern. Later, this information can be used to align the pattern of one component to the pattern of another as, for instance, when the pocket is attached to the chest panel, the pattern will be correctly aligned.

Figure 13:
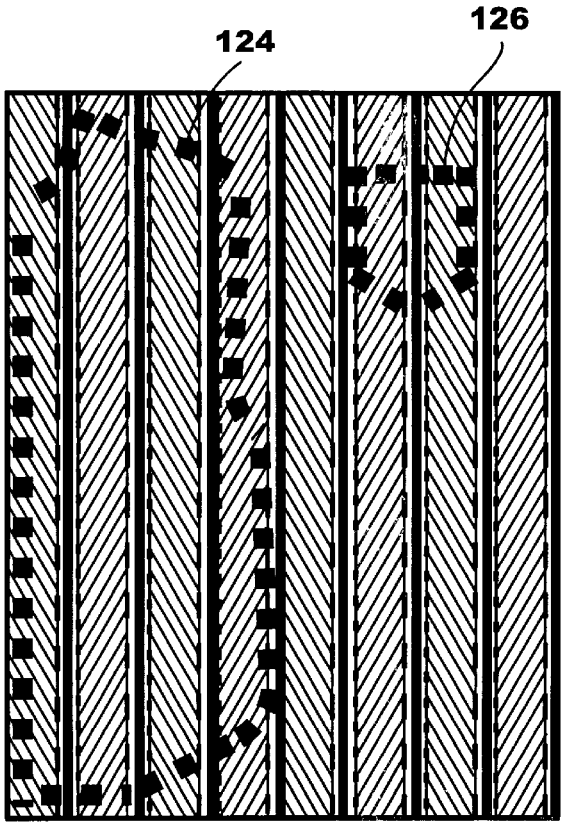
FIG. 13 is a top plan view of a piece of cloth with cutting lines for 2 shirt components printed thereon.

Additionally, as depicted in FIG. 13, the cloth can be printed with cutting instructions 124 and 126 and assembly instructions, as depicted in FIG. 6, prior to the cutting operation. These markings are then used to direct the cloth cutter, thus eliminating the need for the cutter to be driven directly by the CAD file. In this fashion, entire garments can be printed in much the same way that a color document is printed today. Thereafter the cutting can proceed. As the cloth is sensed the knife follows the correct cutting path even if the cloth is slightly stretched or slightly bunched. The matrix markings 48 and 50 (FIGS. 1 and 2) can be used to actuate spreading operations during the cutting operation.

Figure 14:
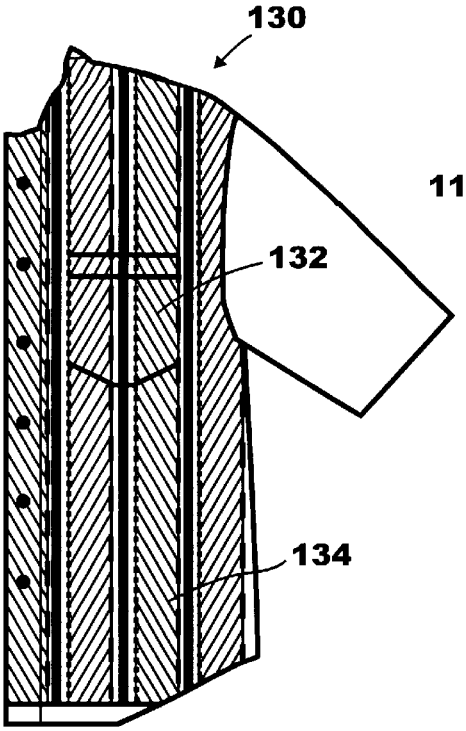
FIG. 14 is a top plan view of the finished shirt component.

FIG. 14 depicts the finished garment component 130 wherein the pattern on the pocket 132 matches perfectly with the pattern on the front panel component 134 due to the use of the cutting and alignment techniques described in the preceding paragraphs.

In accordance with one form of the method of the invention, when two components are to be interconnected together, the edge of the first piece is appropriately positioned on the second piece and is tolerance bound to a line printed on the second piece. The alignment markings or the datum connector indicia imprinted on the fabric components are also tolerance bound. Once validated the pieces are held together while the stitches are applied along the specified stitch line. Additionally, as earlier discussed, the top and bottom grid markings can also be used to verify the correct fold or layering of the individual components. Further as previously mentioned, buttons can be located in accordance with the aforementioned button orientation and identification markings. Similarly, pocket plackets can be located by placing a pre-folded or pre-ironed placket onto the target frame and thereafter sewing the pocket in place in accordance with the instructional material printed on the pocket and on a component to which the pocket is to be affixed. It is to be understood that various modifications to the apparatus and method of the invention can be made without departing from the scope of the invention. For example, while the indicia scanners shown in the drawings and described herein are adapted for use in the horizontal plane, it is to be understood that similar sensors can be deployed in a curved assembly station for accomplishing non-horizontal sewing operations, such as sewing operations performed on sleeves, cuffs and the like. Similarly, a wide variety of international information, other than that specifically described herein can be imprinted on the starting material to communicate information to the sewing apparatus and to assist the operator in monitoring the sewing, folding and placement operations involved in the fabrication of a particular sewn article.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method for producing from a starting fabric material a printed material having a central portion and a margin circumscribing said central portion for use in manufacturing sewn clothing in accordance with instructional information, said method comprising the steps of:

(a) producing a printed material by imprinting instructional information on the starting material at a location interiorly of the margin of the printed material using a radiation excitable ink; and (b) controllably emitting radiation toward said printed material to render said instructional information readable.

2. The method as defined in claim 1 in which the sewn goods are manufactured using a processing apparatus that is operated in accordance with instructional information, the method including the further steps of:

(a) introducing said printed material into said processing apparatus; and (b) reading the instructional information in a manner to cause the processing apparatus to accomplish the operations specified by the instructional information.

3. The method as defined in claim 1 further comprising the step of using a radiation excitable ink that is substantially invisible to the naked eye until excited by the radiation.

4. The method as defined in claim 1 further comprising the step of imprinting the instructional information on both the upper and lower surfaces of the starting material.

5. The method as defined in claim 1 further comprising the step of imprinting on the starting material instructional information comprising stitching instructions.

6. A method for producing from a starting fabric material a printed material having a central portion circumscribed by a margin for use in manufacturing sewn clothing using a computer controlled processing apparatus having emitting means for controllably emitting radiation and having sensor means for sensing and transmitting instructional information to the computer of the processing apparatus, said method comprising the steps of producing the printed material by imprinting instructional information on the starting fabric material interiorly of the margin of said printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

7. The method as defined in claim 6 further comprising the step of imprinting on the starting material instructional information comprises stitching instructions.

8. The method as defined in claim 6 further comprising the step of imprinting on the starting material instructional information comprising starting material positioning instructions.

9. The method as defined in claim 6 further comprising the step of imprinting on the starting material instructional information comprising surface identification information.

10. A method for producing from a starting material a printed material having a central portion circumscribed by a margin for use in manufacturing sewn clothing using a computer controlled sewing apparatus having emitting means for controllably emitting radiation and having sensor means for sensing and transmitting instructional information to the computer of the sewing apparatus comprising the steps of:

(a) using an ink that is excited by radiation, producing a printed starting material by imprinting interiorly of the margin on at least one of the upper and lower surfaces of the starting material instructional information;

(b) introducing said printed starting material into said sewing apparatus;

(c) exciting said excitable ink using the emitting means of the sewing apparatus; and (d) reading the instructional information using the sensor means of the sewing apparatus and then transmitting the instructional information to the computer of the sewing apparatus to accomplish the sewing and movement steps specified by the instructional information.

11. The method as defined in claim 10 further comprising the step of using a radiation excitable ink that is excited by ultraviolet radiation.

12. The method as defined in claim 10 further comprising the step of using a radiation excitable ink that is substantially invisible to the naked eye until excited by the radiation.

13. The method as defined in claim 10 further comprising the step of imprinting in the instructional information on both the upper and lower surfaces of the starting material.

14. The method as defined in claim 13 further comprising the step of imprinting on both the upper and lower surfaces of the starting material instructional information comprising surface identification information.

15. The method as defined in claim 10 further comprising the step of using water soluble invisible ink to imprint the instructional information on the starting fabric material.

16. An apparatus for manufacturing sewn goods from a starting material comprising a plurality or starting material components:

(a) printing means for imprinting instructional material onto the starting material using a radiation excitable ink to form a printed material having a central portion circumscribed by a margin, said instructional material being imprinted interiorly of said margin;

(b) sewing means for sewing the starting material in accordance with said instructional material, said sewing means comprising:

(i) emitting means for controllably emitting radiation in a direction toward said radiation excitable ink, said emitting means comprising a source of ultraviolet radiation; and (ii) sensor means for sensing radiation emitted by said radiation excitable ink, said sensor comprising an ultraviolet sensor.

17. A method for producing from a starting fabric material a printed material for use in manufacturing sewn clothing in accordance with instructional information comprising buttonhole location instructions, said method comprising the steps of:

(a) producing a printed material by imprinting the instructional information comprising buttonhole location instructions on the starting material using a radiation excitable ink; and (b) controllably emitting radiation toward said printed material to render said instructional information readable.

18. A method for producing from a starting fabric material a printed material for use in manufacturing sewn clothing in accordance with instructional information comprising button location instructions, said method comprising the steps of:

(a) producing a printed material by imprinting the instructional information comprising button locations on the starting material using a radiation excitable ink; and (b) controllably emitting radiation toward said printed material to render said instructional information readable.

19. A method for producing from a starting fabric material, a printed material having a central portion circumscribed by a margin for use in manufacturing sewn clothing using a computer controlled processing apparatus having emitting means for controllably emitting radiation and having sensor means for sensing and transmitting instructional information to the computer of the processing apparatus, said method comprising the steps of producing the printed material by imprinting instructional information comprising start and stop instructions on the starting fabric material interiorly of the margin of said printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

20. A method for producing from a starting fabric material, a printed material having a central portion circumscribed by a margin for use in manufacturing sewn clothing using a computer controlled processing apparatus having emitting means for controllably emitting radiation and having sensor means for sensing and transmitting instructional information to the computer of the processing apparatus, said method comprising the steps of producing the printed material by imprinting instructional information comprising starting material feed instructions on the starting fabric material interiorly of the margin of said printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

21. A method for producing from a starting fabric material, a printed material having a central portion circumscribed by a margin for use in manufacturing sewn clothing using a computer controlled processing apparatus having emitting means for controllably emitting radiation and having sensor means for sensing and transmitting instructional information to the computer of the processing apparatus, said method comprising the steps of producing the printed material by imprinting instructional information comprising component positioning information on the starting fabric material interiorly of the printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

22. A method for producing from a starting fabric material, a printed material having a central portion circumscribed by a margin for use in manufacturing sewn clothing using a computer controlled processing apparatus having emmitting means for controllably emitting radiation and having sensor means for sensing and transmitting instructional information to the computer of the processing apparatus, said method comprising the steps of producing the printed material by imprinting instructional information comprising buttonhole location instructions on the starting fabric material interiorly of the margin of said printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

23. A method for producing from a starting fabric material, a printed material having a central portion circumscribed by a margin for use in manufacturing sewn clothing using a computer controlled processing apparatus having emitting means for controllably emitting radiation and having sensor means for sensing and transmitting instructional information to the computer of the processing apparatus, said method comprising the steps of producing the printed material by imprinting instructional information comprising buttonhole location instructions on the starting fabric material interiorly of the margin of said printed material using a radiation excitable ink; using said emitting means, emitting radiation toward said central portion of said printed material to excite said radiation excitable ink; and using said sensor means, reading said instructional information and then transmitting said instructional information to the computer of the processing apparatus.

24. A method for producing from a starting fabric material comprising a plurality of starting material components a printed material for use in manufacturing sewn clothing in accordance with instructional information comprising matrix patterns and grid patter said method comprising the steps of:

(a) producing a printed material by imprinting instructional information comprising the matrix patterns and grid patterns on the starting material using a radiation excitable ink; and (b) controllably emitting radiation toward said printed material to render said instructional information readable.

25. A method for producing from a starting fabric material comprising a plurality of starting material components a printed material for use in manufacturing sewn clothing using a processing apparatus for moving the starting material components along a line of travel, said method being accomplished in accordance with instructional information comprising stitching instructions disposed parallel to the line of travel, said method comprising the steps of:

(a) producing a printed material by imprinting the instructional information comprising the stitching instructions on the starting material using a radiation excitable ink; and (b) controllably emitting radiation toward said printed material to render said instructional information readable.

26. A method for producing from a starting fabric material comprising a plurality of starting material components, each printed material having a central portion circumscribed by a margin, for use in manufacturing sewn clothing in accordance with instructional information, said method comprising the steps of:

(a) producing a printed material by imprinting the instructional information on the starting material interiorly of the margin of the printed material using a radiation excitable ink; and (b) controllably emitting radiation toward said printed material to render said instructional information readable.

27. A method for producing from a starting fabric material comprising a plurality of starting material components a printed material for use in manufacturing sewn clothing using a robotic cloth movement system, said method being accomplished in accordance with instructional information comprising orientation markings to enable the robotic cloth movement system to orient the components, said method comprising the steps of:

(a) producing a printed material by imprinting the instructional information comprising the orientation markings on the starting material using a radiation excitable ink; and (b) controllably emitting radiation toward said printed material to render said instructional information readable.

28. A method for producing from a starting fabric material comprising a plurality of starting material components a printed material for use in manufacturing sewn clothing using a processing apparatus having a translatable sewing head, said method being accomplished in accordance with instructional information comprising machine translate lines for indicating the direction of translation of the sewing head, said method comprising the steps of:

(a) producing a printed material by imprinting the instructional information comprising the machine translate lines on the starting material using a radiation excitable ink; and (b) controllably emitting radiation toward said printed material to render said instructional information readable.

29. A method for producing from a starting fabric material comprising a printed material, said printed material having a central portion circumscribed by a margin, said printed material being fully flexible and foldable during use, said printed material being used in the manufacture of flexible, foldable sewn goods in accordance with instructional information comprising stitching instructions, said method comprising steps of:

(a) producing a printed material by imprinting the instructional information comprising the stitching instructions on the starting material interiorly of the margin of the printed material using a radiation excitable ink; and (b) controllably emitting radiation toward said printed material to render said instructional information readable.

* * * * *